US007987675B2

(12) United States Patent
Panchatsaram et al.

(10) Patent No.: US 7,987,675 B2
(45) Date of Patent: Aug. 2, 2011

(54) PROVISION FOR RAPID WARMING OF STEAM PIPING OF A POWER PLANT

(75) Inventors: Thileepan Panchatsaram, Bangalore (IN); Aslam Basha, Bangalore (IN)

(73) Assignee: General Electric Company, Schenectady, NY (US)

( * ) Notice: Subject to any disclaimer, the term of this patent is extended or adjusted under 35 U.S.C. 154(b) by 442 days.

(21) Appl. No.: 12/261,398

(22) Filed: Oct. 30, 2008

(65) Prior Publication Data

US 2010/0107636 A1 May 6, 2010

(51) Int. Cl.
*F01K 13/02* (2006.01)

(52) U.S. Cl. ..... 60/646; 60/657

(58) Field of Classification Search ..... 60/646, 60/657

See application file for complete search history.

(56) References Cited

U.S. PATENT DOCUMENTS 3,243,961 A * 4/1966 Caracristi ..... 60/646
3,271,961 A * 9/1966 Wiener ..... 60/646
4,099,384 A * 7/1978 Stevens et al. ..... 60/657
4,316,362 A * 2/1982 Ninomiya et al. ..... 60/646
4,425,762 A * 1/1984 Wakamatsu et al. ..... 60/646
4,651,532 A * 3/1987 Abe ..... 60/646
5,412,936 A * 5/1995 Lee et al. ..... 60/801

* cited by examiner

*Primary Examiner* — Hoang M Nguyen

(74) *Attorney, Agent, or Firm* — Cantor Colburn LLP

(57) ABSTRACT

A steam power plant, in which steam from a steam generator is received by a steam turbine, is provided and includes a conduit, a main steam control valve (MSCV) disposed along the conduit to admit the steam to the steam turbine when a characteristic thereof satisfies a threshold, a bypass line, coupled to the conduit between a super-heater and a valve, including a bypass line valve which is opened until the threshold is satisfied such that the bypass line removes a portion of the steam, an evacuator line, coupled to the conduit between the MSCV and the steam turbine, including an evacuator valve which is opened to regulate a thermal environment within the steam turbine during a start up thereof, and a warming line originating between the valve and the MSCV on the conduit and terminating downstream of the evacuator valve disposed along the evacuator line.

9 Claims, 1 Drawing Sheet

PROVISION FOR RAPID WARMING OF STEAM PIPING OF A POWER PLANT

BACKGROUND OF THE INVENTION

In general, a steam power plant includes a heat source, a steam generator by which steam is generated at multiple pressure levels and heated to a desired superheated level by the heat of the heat source and a system, such as a steam turbine, in which the steam is used for power generation by expansion in the steam turbine.

In such a power plant, steam produced in this manner is transmitted along steam pipelines to the steam turbine. Typically, just upstream of the steam turbine is a main steam control valve (MSCV) located in the steam pipeline. During startup of the steam turbine, the MSCV is kept in a closed condition until the steam in the steam pipeline reaches certain minimum conditions (i.e., minimum temperatures and/or pressures).

Once the minimum conditions are reached, the MSCV is opened and a portion of the steam is permitted to enter the high pressure steam turbine (HPST) where the steam is employed for power generation. The portion of the steam that is not permitted to enter the HPST is diverted to a condenser or to a re-heater of the steam generator by the opening of a bypass valve which is disposed along a bypass line. The steam pipeline has several drain lines provided with drain valves that branch off from it. These drain lines remove steam and/or water that might form by the condensation of steam present in the line during the start up of the power plant.

With this configuration, the time required for the steam to reach the required minimum conditions at the MSCV inlet is relatively long due to improper warming and/or draining of steam pipeline. Therefore, the start up time for the power plant is lengthened. As a result, the overall efficiency of the power plant may be decreased.

BRIEF DESCRIPTION OF THE INVENTION

In accordance with an aspect of the invention, a steam power plant in which steam, generated by utilization of heat of a heat source by a steam generator, is received by a steam turbine for use in power generation is provided and includes a flowpath conduit to couple the steam generator and the steam turbine, a main steam control valve (MSCV) disposed along the flowpath conduit upstream of the steam turbine to admit the steam to the steam turbine when a characteristic thereof satisfies a threshold, a bypass line, coupled to the flowpath conduit between a super-heater of the steam generator and a valve, including a bypass line valve which is opened until the threshold is satisfied such that the bypass line removes a portion of the steam from the flowpath conduit, an evacuator line, coupled to the flowpath conduit between the MSCV and the steam turbine, including an evacuator valve which is opened to regulate a thermal environment within the steam turbine during a start up thereof, and a warming line, including a warming line valve, coupled to the flowpath conduit between the valve and the MSCV and terminating on the evacuator line downstream of the evacuator valve, to remove an additional portion of the steam from the flowpath conduit.

In accordance with an aspect of the invention, a method of operating a steam power plant in which steam is received via piping, by a steam turbine for use in power generation is provided and includes removing a portion of the steam from the piping upstream of a main steam control valve (MSCV), disposed along the piping, to admit the steam to the steam turbine when a characteristic thereof satisfies a threshold, dumping the removed steam into an evacuator line which discharges the removed steam into a condenser, and ceasing the removal of the portion of the steam and opening the MSCV to admit the steam to the steam turbine when the steam characteristic at the inlet of the MSCV satisfies the threshold.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

Figure 1:
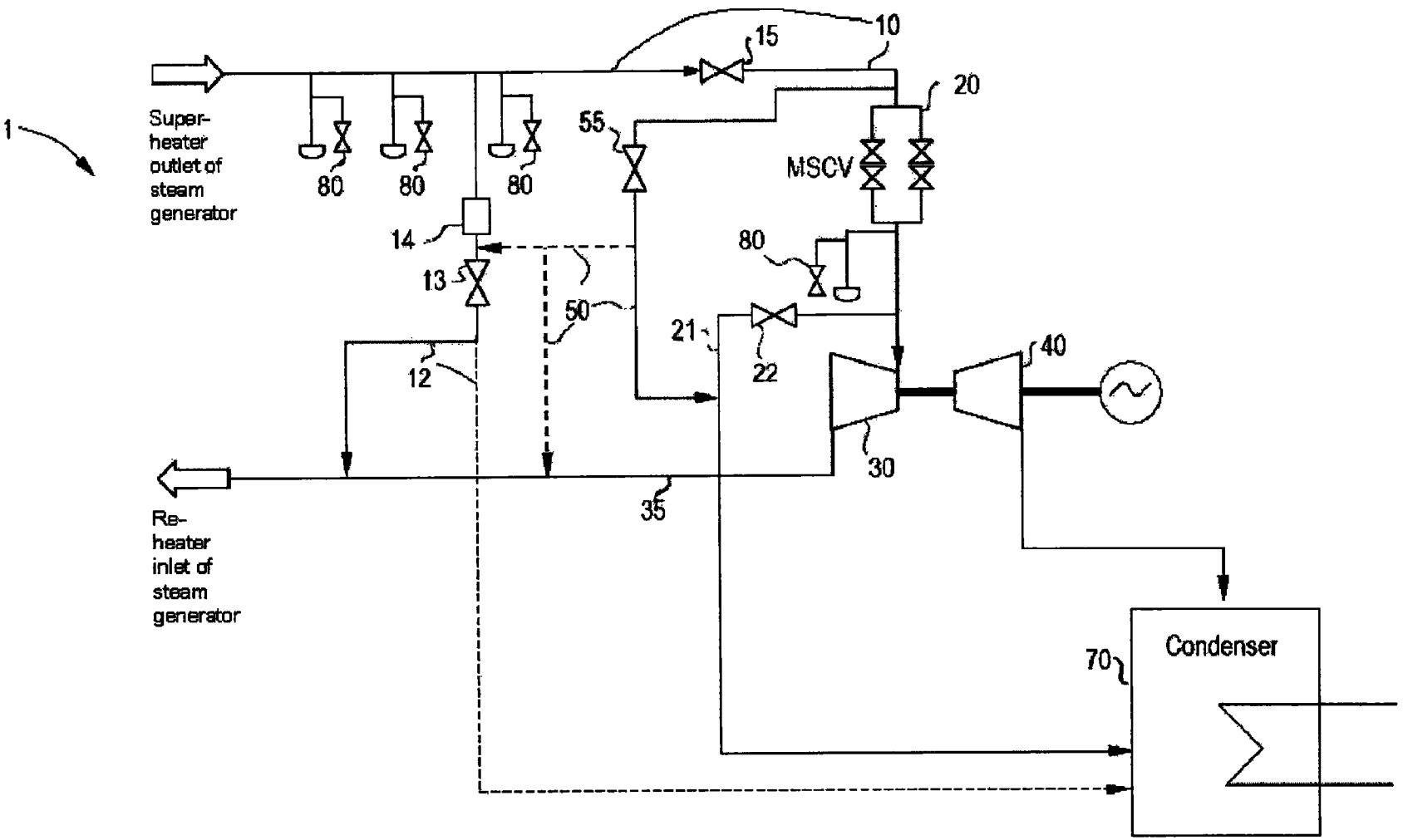
FIG. 1 is a schematic diagram showing steam pipelines of an exemplary power plant, a steam turbine and steam pipelines connected to the steam turbine.

The detailed description explains embodiments of the invention, together with advantages and features, by way of example with reference to the drawings.

DETAILED DESCRIPTION OF THE INVENTION

With reference to FIG. 1, a steam power plant 1 is provided which includes a flowpath conduit, such as a steam pipeline 10, to couple the heat generator and the high pressure steam turbine (HPST) 30 with one another, and a main steam control valve (MSCV) 20, disposed along the piping upstream of the HPST 30, to admit the steam to the HPST 30 when a characteristic thereof satisfies a threshold.

During the start up of the steam power plant 1, steam cannot be admitted to the HPST 30 unless the steam has a certain minimum temperature and/or a certain minimum pressure based on the operational specifications of the HPST 30 Upon a start up of the power plant 1, depending on the state of the plant before start up, the temperature and pressure of the steam generated by the steam generator will not meet the certain minimums upstream of the MSCV 20 due to improper warming and draining of steam pipeline 10.

To insure that the MSCV 20 does not open until the minimum condition(s) are met, it is understood that the MSCV 20 includes temperature and pressure sensors, which are operationally coupled to the MSCV 20 and disposed within the steam pipeline 10 in respective positions with access to the steam.

The power plant 1 includes an evacuator line 21 which is coupled to the steam pipeline 10 at a location between the MSCV 20 and the HPST 30 and which includes an evacuator valve 22. The evacuator line 21 is employed during the starting of the HPST 30 or the intermediate pressure steam turbine (IPST) 40 to control the thermal environment within the HPST 30 or the IPST 40 by removing steam from within the HPST 30 and the IPST 40 and dumping the removed steam into the condenser 70.

A warming line 50 is coupled to the steam pipeline 10 at a location upstream of the MSCV 20 and terminating at a location downstream of the evacuator valve 22 on the evacuator line 21. The warming line 50 includes a warming line valve 55, which is opened to allow the warming line 50 to remove steam from the steam pipeline 10 and closed to prevent removal of steam from the steam pipeline 10. In this way, with the warming line valve 55 open, the steam being removed from the steam pipeline 10 causes increases in an amount of the steam flowing through the section of the steam pipeline 10 downstream of the location of the coupling of bypass line 12 with the steam pipeline 10. Due to the increased steam flow experienced by the section of the steam pipeline 10, the minimum conditions for the steam to be admitted to the HPST 30 is attained relatively quickly as compared to that of a power plant which does not include the warming line 50.

In this invention, with the warming line valve 55 open, a relatively large quantity of steam that has not yet reached the temperature and/or pressure threshold for admittance to the HPST 30 is removed from the steam pipeline 10 and supplied via the evacuator line 21 to the condenser 70.

In a still further embodiment, the warming line 50 may be additionally or alternately coupled to the steam pipe 35 either directly or via the bypass line 12 which is coupled to the steam pipeline 10 at a location that is, in some cases, proximate to drain valves 80. In this case, the location of termination of warming line 50 would be upstream of the valve 13 with the provision of an additional pressure drop device 14 upstream of the location of connection so that, when the warming line valve 55 and bypass line valve 13 are each opened, warming steam can be transported to the bypass line 12 and then to steam pipe 35 from the steam pipeline 10.

In accordance with another aspect of the invention, a method of operating a steam power plant 1 in which steam is received via a steam pipeline 10, including a valve 15, by at least one steam turbine 30, 40 for use in power generation is provided. The method includes removing a portion of the steam from the steam pipeline 10 downstream of the valve 15 and upstream from a main steam control valve (MSCV) 20, which is disposed along the steam pipeline 10 to admit the steam to the steam turbine 30, 40 when a characteristic thereof satisfies a threshold. The method further includes ceasing the removal of the portion of the steam and opening the MSCV 20 to admit the steam to the steam turbine 30, 40 when the characteristic satisfies the threshold.

In accordance with the aspects discussed above, it is understood that the schematic of the power plant 1 may be part of any combined cycle or Rankine cycle power plant.

While the disclosure has been described with reference to exemplary embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof Therefore, it is intended that the disclosure not be limited to the particular exemplary embodiment disclosed as the best mode contemplated for carrying out this disclosure, but that the disclosure will include all embodiments falling within the scope of the appended claims.

The invention claimed is:

1. A steam power plant in which steam, generated by utilization of heat of a heat source by a steam generator, is received by a steam turbine for use in power generation, the power plant comprising:

a flowpath conduit to couple the steam generator and the steam turbine;

a main steam control valve (MSCV) disposed along the flowpath conduit upstream of the steam turbine to admit the steam to the steam turbine when a characteristic thereof satisfies a threshold;

a bypass line, coupled to the flowpath conduit between a super-heater of the steam generator and a conduit valve disposed upstream from the MSCV, the bypass line including a bypass line valve which is opened until the threshold is satisfied such that the bypass line removes a portion of the steam from the flowpath conduit;

an evacuator line, coupled to the flowpath conduit between the MSCV and the steam turbine, including an evacuator valve which is opened to regulate a thermal environment within the steam turbine during a start up thereof; and a warming line, including a warming line valve, coupled to the flowpath conduit between the conduit valve and the MSCV and terminating on the evacuator line downstream of the evacuator valve, to remove an additional portion of the steam from the flowpath conduit.

2. The power plant according to claim 1, further comprising a condenser to which the evacuator line is coupled.

3. The power plant according to claim 2, further comprising a cold reheat (CRH) line connected to an outlet of the steam turbine and a re-heater of the steam generator.

4. The power plant according to claim 3, wherein the bypass line is coupled to at least one of the CRH line or the condenser.

5. A method of operating a steam power plant in which steam is received via a flowpath conduit, by a steam turbine for use in power generation, the method comprising:

removing a portion of the steam from the flowpath conduit upstream of a main steam control valve (MSCV), disposed along the flowpath conduit, to admit the steam to the steam turbine when a characteristic thereof satisfies a threshold;

dumping the removed steam into an evacuator line, which is coupled to the flowpath conduit downstream from the MSCV, and which discharges the removed steam into a condenser; and ceasing the removal of the portion of the steam and opening the MSCV to admit the steam to the steam turbine when the steam characteristic at the inlet of the MSCV satisfies the threshold.

6. The method according to claim 5, further comprising removing steam from the flowpath conduit upstream from a valve disposed along the flowpath conduit.

7. The method according to claim 6, further comprising dumping the steam removed from the flowpath conduit upstream from the valve into the condenser or a cold reheat (CRH) line coupled to an output of the steam turbine.

8. The method according to claim 6, further comprising ceasing the removing of the steam from the flowpath conduit upstream from the valve when the steam characteristic at the inlet of the MSCV satisfies the threshold.

9. The method according to claim 6, wherein the removing of the portion of the steam from the flowpath conduit is accomplished downstream from the valve.

* * * * *